United States Patent [19]

Thebert

[11] 4,247,247

[45] Jan. 27, 1981

[54] BLADE TIP CLEARANCE CONTROL

[75] Inventor: Glenn W. Thebert, Carmel, Ind.

[73] Assignee: General Motors Corporation, Detroit, Mich.

[21] Appl. No.: 42,979

[22] Filed: May 29, 1979

[51] Int. Cl.[3] ..... F01D 11/00

[52] U.S. Cl. ..... 415/113; 415/171

[58] Field of Search ..... 415/13, 110, 113, 174, 415/171, 170 R, 173 R, 172 A, 172 R, 116, 117, 126, 175

[56] References Cited

U.S. PATENT DOCUMENTS

| | | | |
|---|---|---|---|
| 2,686,657 | 8/1954 | Kalitinsky | 415/113 |
| 2,927,724 | 3/1960 | Wardle | 415/113 |
| 2,994,472 | 8/1961 | Botje | 415/174 |
| 3,039,737 | 6/1962 | Kolthoff | 415/17 |
| 3,834,001 | 9/1974 | Carroll et al. | 29/414 |
| 3,860,358 | 1/1975 | Cavicchi et al. | 415/170 |

*Primary Examiner*—Carlton R. Croyle
*Assistant Examiner*—A. N. Trausch, III
*Attorney, Agent, or Firm*—J. C. Evans

[57] ABSTRACT

A turbine blade tip seal assembly for controlling the blade tip clearance between a flexible outer shroud and the tips of a thermally expansible row of turbine blades on a turbine rotor includes a fixed outer shroud with a pressure deflectable wall portion thereon located in surrounding, radially outwardly relationship with blade tips on the blades of a turbine rotor and wherein an excessive blade tip to shroud wall spacing is maintained when the engine is at cold start conditions; said turbine blades of the turbine rotor expanding in response to increases in operating temperature within the engine during turbine engine operation to partially close the excessive blade tip to shroud clearance and further including pressurizable means responsive to turbine operation to produce pressure bias on the deflectable wall to cause it to be deflected raidally inwardly to further reduce the excessive blade tip clearance so as to produce a resultant operative clearance between the tip of the turbine rotor and the shroud to prevent excessive gas bypass between the wall and the blade tips; said pressurizable means including a secondary pressurizable chamber responsive to engine operating conditions to apply a secondary pressure on the wall to produce a fine-tuned adjustment of the blade tip clearances between leading and trailing edges of the blades when the engine has reached an elevated equilibrium temperature of operation.

4 Claims, 4 Drawing Figures

BLADE TIP CLEARANCE CONTROL

This invention relates to blade tip clearance systems for preventing excessive gas bypass between an annular shroud surrounding the tips of a row of blades on a turbomachine rotor and more specifically to means for compensating for differential expansion between the higher temperature operating blade components of a turbine rotor and cooler operation surrounding shroud components therein.

Various proposals have been utilized to maintain a close clearance between the tips of a row of turbomachine blades and a radially outwardly located annular shroud that surrounds the row of blades on the turbomachine rotor so as to prevent excessive gas bypass at the blade tips. Thus, during rotation of a rotor with respect to an outer annular shroud tips of hotter running blade components of the turbomachine rotor are expanded into an abraidable relationship with a porous seal structure. The porous seal is worn away to define a close running clearance between the blade tips and the shroud element of the turbomachine. An example of such a system is set forth in U.S. Pat. No. 3,834,001, issued Sept. 10, 1974, to Carroll et al, for METHOD OF MAKING A POROUS LAMINATED SEAL ELEMENT.

Another approach to maintain close rotor to shroud clearances is set forth in U.S. Pat. No. 2,927,724, issued Mar. 8, 1960, to Wardle for FLOATING BLADE SHROUDS. In this arrangement an annular floating ring is secured to a circumferential slot machined in an outer shroud wall in surrounding relationship to a rotor member. Each of the annular rings includes a plurality of segments having a radius of curvature equal to that of the slot in the wall. The free edge of each section of the ring has a lip which is in sealing contact with the shroud wall and slidable relative thereto. The rotor member has a shroud interconnecting the rotor blade tips to prevent excessive bypass therefrom. The outer floating ring then moves with respect to the outer surface of the rotor shroud to accommodate differences in thermal expansion between the component parts of the operating engine.

Yet another arrangement for controlling clearance between a rotor and a surrounding shroud of a gas turbine engine is set forth in U.S. Pat. No. 3,039,737, issued June 19, 1962, to Kolthoff, Jr. for DEVICE FOR CONTROLLING CLEARANCE BETWEEN ROTOR AND SHROUD OF A TURBINE. In this arrangement a controlled amount of heated gas is passed through a reinforced outer annular outer shroud to cause it to be heated in accordance with engine operation and to expand at a rate like that of the heated components of a rotor blade system thereby to maintain a close running clearance between the tips of the blades and the surrounding shroud. The system depends upon maintaining a normalized temperature both at the shroud and the rotor components.

An object of the present invention is to provide an improved system for controlling the relationship between the clearance of an outer shroud and the outer tips of a row of blades on a turbomachine rotor of a gas turbine engine by the provision therein of a rotor having blades configured to space the tips thereof in an excessive cold start clearance relationship with respect to the inner surface of a shroud structure and wherein the excessive clearance is in part reduced because of thermal expansion of the blades of the turbomachine rotor and wherein means are associated with the shroud structure to be responsive to a build-up of pressure within the shroud structure to cause an inner wall segment thereof to deflect radially inwardly of the shroud to further close the excessive tip to shroud clearance and wherein the pressurization to the chamber is in accordance with increase of the operating temperature of the gas turbine engine and at a pressure level to cause the inner wall to deflect to a point to compensate for a lesser radially inward thermal expansion of the outer shroud with respect to the turbomachine rotor to cause a combined wall deflection and blade tip thermal growth to produce and maintain a closely controlled running clearance between the blade tips and the surrounding shroud when the turbine engine has reached a stabilized elevated equilibrium temperature of operation.

Yet another object of the present invention is to provide an improved turbine rotor blade tip seal assembly for controlling blade tip clearance between a turbine rotor and a surrounding outer annular shroud by the provision of a fixed outer shroud member having an inwardly facing deflectable wall thereon maintained at an excessive spaced relationship with blade tips on a turbine rotor when the engine is inoperative and wherein means are included in the fixed outer shroud to define a first pressurizable chamber to direct a predetermined fluid pressure on the deflectable wall to cause it to move radially inwardly to close excessive radial clearance between the blade tips and the outer annular wall thereby to prevent excessive gas bypass between the outer shroud wall and the blade tips when the engine has reached an elevated equilibrium temperature of operation.

Still another object of the present invention is to provide an improved turbine blade tip and shroud wall clearance system including a main shroud wall defining the main structure of the outer case of the turbine having an annular chamber therein formed in part by a thin-sectioned annular deflectable wall on the shroud located in radially outwardly spaced relationship to tips of a plurality of turbine rotor blades driven by motive gas flow between the outer shroud and the rim of the rotor; the blades thermally expanding radially outwardly from a cold start position to a lengthened state at an elevated equilibrium temperature of engine operation; the blade tips being spaced an excessive distance from the deflectable wall under cold start conditions and partially expanding in response to operation of the elevated equilibrium temperature conditions of engine operation to partially close the excessive clearance between the blade tips and the outer shroud and wherein means are provided to pressurize the deflectable wall in stages to further close the excessive clearance between the blade tips and the outer shroud so as to maintain a close operating clearance between the blade tips and the shroud so as to prevent excessive gas bypass at the tips during gas turbine engine operation.

Yet another object of the present invention is to provide a tip clearance control assembly of the type set forth in the preceding object wherein a first chamber is formed in the annular shroud to pressurize the full surface of the deflectable wall and a plurality of secondary chambers are formed therein including means for producing localized loading of the deflectable wall in addition to a background pressure loading thereon so as to closely control the clearance between the leading and the trailing edges of a tip segment on each of the blades of the turbine rotor when the engine reaches its elevated equilibrium temperature condition of operation.

Further objects and advantages of the present invention will be apparent from the following description, reference being had to the accompanying drawings wherein a preferred embodiment of the present invention is clearly shown.

Figure 1:
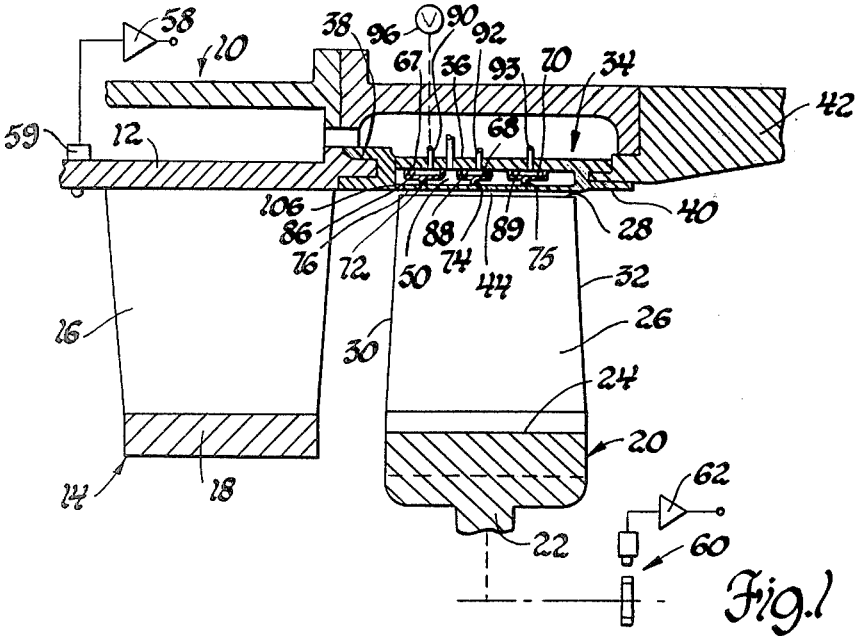
FIG. 1 is a schematic, partial sectional view of an axial turbine taken on a plane containing the axis of rotation thereof and including the tip clearance control assembly of the present invention.

FIG. 1 is included to show the outlines of a structure of a typical axial flow turbine of the type used in a gas turbine engine, sufficiently detailed for explanation of the improved blade tip clearance assembly of the present invention. More particularly, an outer turbine case 10 supportingly contains an outer shroud 12 of a turbine nozzle ring 14 with a plurality of turbine vanes 16 thereon connected to shroud 12 and an inner annular band 18 of the nozzle ring 14 to direct motive fluid from a gas turbine engine combustor to a downstream rotor state 20 that includes a rotor wheel 22 having an annular rim 24 thereon. The rotor wheel 22 includes a plurality of radially outwardly directed rotor blades 26, each including an outer tip 28, a leading edge 30 and a trailing edge 32. In accordance with the present invention, the outer tip 28 on each of the blades 26 on the rotor wheel 22 is associated with an improved, pressure controlled, blade tip clearance control assembly 34 in accordance with the present invention. More particularly, the clearance control assembly 34 includes a main wall structure 36 connected at a forward flange 38 thereon to the turbine case 10 and at an aft flange 40 on an annular wall structure 42 which may be the turbine exhaust duct or in other cases might be the structural case for a succeeding turbine stage. More particularly, in accordance with the present invention, initially under cold start conditions each of the blade tips 28 is located at a controlled clearance gap 44 with respect to the assembly 34 in excess of the radial thermal growth of each of the rotor blades 26 which occurs in response to the engine reaching an elevated equilibrium temperature of operation following cold start conditions.

Figure 2:
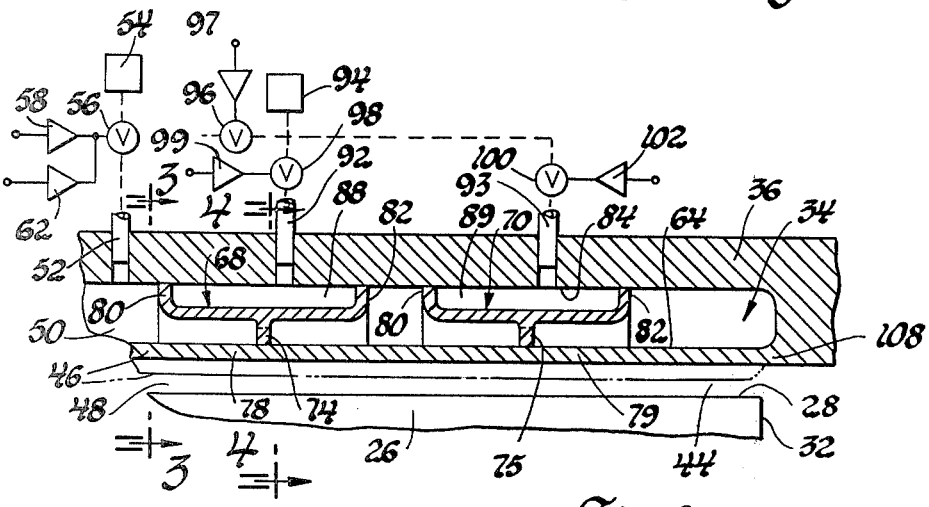
FIG. 2 is an enlarged sectional view of a plural chamber pressurization structure for controlling the radial position of the inner surface of a blade tip shroud in the assembly of FIG. 1.
Figure 3:
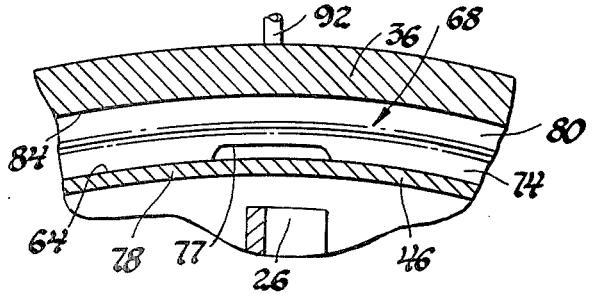
FIG. 3 is a fragmentary cross-sectional view taken along the line 3—3 of FIG. 2 looking in the direction of the arrows.
Figure 4:
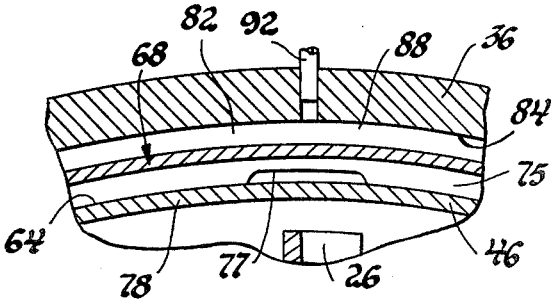
FIG. 4 is a fragmentary cross-sectional view taken along the line 4—4 of FIG. 2 looking in the direction of the arrows.

However, the thermal growth alone is not sufficient to reduce the gap 44 to a point that prevents excessive gas bypass between the individual rotor blades 26 of the rotor stage 20. In accordance with the present invention, the remaining clearance is closely regulated by means of a two-stage pressure control operation that selectively deflects a thin-sectioned deflectable wall 46 of the regulator assembly 34 with respect to the outer tip 28 in a staged manner from the leading edge 30 to the trailing edge 32 of each of the rotor blades 26 so as to effect a precisely controlled final clearance gap 48 which is shown in FIG. 2 between a deflected broken line outline position of the thin sectioned deflectable wall 46 and the tips 28 of the rotor blades 26 at their elevated temperature conditions of operation. Heretofore, various proposals have been suggested to accommodate such thermal expansion by use of abraidable seals and/or mechanisms and arrangements for heating the outer shroud to the same elevated temperature as the operating temperature of the rotor when the engine reaches its elevated equilibrium temperature condition of operation. In the present case, a selective deflection of the thin-sectioned wall 46 is obtained by a two-stage pressure system including a first cavity 50 formed in the main wall structure 36 at a point radially outwardly of the annular thin-sectioned deflectable wall 46. Cavity 50 communicates with a conduit 52 that is connected to a first pressure source 54 under the control of suitable valve means 56 that is responsive to an input such as a temperature signal from an amplifier 58 connected to a thermocouple 59 that senses the motive gas temperature within the turbine. Or, alternatively, the valve means 56 can be responsive to the speed of the rotor wheel 22 which is directly related to increases in the temperature of operation of the turbomachine.

In the case of the speed responsive system a tachometer 60 is arranged to sense the speed of rotation of the rotor wheel 22 and is connected to an amplifier 62 to generate a signal to regulate the valve means 56 in accordance therewith.

The first pressure source is thereby directed into the cavity 50 when the engine is operated following the cold start condition, thereby to produce a resultant pressure loading of the inner surface 64 of the thin-sectioned deflectable wall 46 to cause a partial closure of the controlled clearance 44 which is initially greater than the amount of radial thermal growth to be expected from each of the rotor blades 26 as they thermally grow in response to increases in the turbine operating temperatures.

In addition to the first deflection of the deflectable wall 46 produced by pressure acting on the inner surface 64 thereof, the blade tip clearance control assembly 34 further includes a secondary pressurization system including spaced annular channels 67, 68, 70, each having an annular dependent rib 72, 74, 75 therefrom that is in engagement with the inner surface 64 at spaced annular segments 76, 78, 79 thereon. Each rib 72, 74, 75 has slots 77 formed therein to equalize pressures throughout cavity 50. Each of the channels 67, 68, 70 includes side walls 80, 82 thereon in engagement with the inner surface 84 of the main wall structure 36 defining the annular cavity 50 therein, thereby to form separate annular pressurizable chambers 86, 88, 89 that can be communicated by conduits 90, 92, 93, respectively, to pressure source 94. Valve means 96, 98, 100 are interposed between the source 94 and conduits 90, 92, 93 to selectively regulate pressure levels within each of the channels 67, 70. In order to further control the shape of the deflected wall 46 to closely regulate the clearance from the leading and trailing edges 30, 32 of the blade tips, the annular pressure chambers 86, 88, 89 can be pressured to varying levels to impose selective point loadings on the deflectable wall so that it will be shaped precisely to the variable amount of thermal growth which will occur from the leading edge 30 to the trailing edge 32 of the blade in the region of the outer tip 28 thereof. To accomplish this, signals from thermocouple 59 and/or tachometer 60 are modified by amplifiers 97, 99, 102 and valves 96, 98, 100 are controlled to produce staged pressurization of chambers 86, 88, 89. Accordingly, the blade tip clearance control assembly is precisely regulated in accordance with the amount of wall deflection that is required to adjust the cold start clearance gap 44 to produce a resultant final clearance gap 48 that compensates for any variable thermal growth between the leading edge and the trailing edge of the outer tip so as to precisely deflect the thin-sectioned deflectable wall 46 from an annular segment 106 thereof that is fixed to the main wall structure 36 and to a trailing annular segment 108 that is connected to the main wall structure 36 at a point immediately downstream of the trailing edge 32 of each of the rotor blades 26.

The multiple pressure controls that are afforded by the valve means 56, 96, 98, 100 and the specific structure that produces an initial overall pressure loading and deflection of the thin-sectioned deflectable wall and a modulated and exact spot load adjustment of the deflectable wall to tailor its shape to the amount of growth between the leading and trailing edge of each of the blades 26 enables a closely controlled regulation of running clearances between rotor blade tips and the inner shroud so as to substantially eliminate gas bypass thereby to improve the overall gas flow cycle efficiency of a gas turbine engine.

While the embodiment of the present invention, as herein disclosed, constitutes a preferred form, it is to be understood that other forms might be adopted.

The embodiments of the invention in which an exclusive property or privilege is claimed are defined as follows:

1. A turbine blade tip seal assembly for use in controlling blade tip gas bypass as motive fluid is directed across a turbine blade row comprising: a fixed outer shroud with a deflectable wall, turbine rotor having blades thereon with tips located in spaced relationship to said deflectable wall, means forming a first pressurizable chamber inflatable to a predetermined pressure to deflect said deflectable wall radially inwardly into a controlled radial clearance with said tips to prevent excessive gas bypass between said wall and said blade tips, and means including a secondary pressurizable chamber responsive to engine operating conditions to apply a secondary pressure on said wall to produce a further adjustment of said clearance in accordance with engine operating conditions.

2. A turbine blade tip seal assembly for use in controlling blade tip gas bypass as motive fluid is directed across a turbine blade row comprising; a fixed outer shroud with a deflectable wall, a turbine rotor having blades thereon with tips located in spaced relationship to said deflectable wall, means forming a first pressurizable chamber inflatable to a predetermined pressure to deflect said deflectable wall radially inwardly into a controlled radial clearance with said tips to prevent excessive gas bypass between said wall and said blade tips, and means including a secondary pressurizable chamber responsive to engine operating conditions to apply a secondary pressure on said wall to produce a further adjustment of said clearance in accordance with engine operating conditions, said outer shroud having axially spaced rigid end segments and an outer wall defining an annular cavity, said deflectable wall being spaced from said outer wall and defining the inner surface of said outer shroud and the inner wall of the cavity thereby to define said first pressurizable chamber, said last mentioned means being located within said first cavity.

3. A turbine blade tip seal assembly for use in controlling blade tip gas bypass as motive fluid is directed across a turbine blade row comprising: a fixed outer shroud with a deflectable wall turbine rotor having blades thereon with tips located in close spaced relationship to said deflectable wall and including leading and trailing edges, means forming a first pressurizable chamber inflatable to a predetermined pressure to deflect said wall radially inwardly into a controlled radial clearance with said tips to prevent excessive gas bypass between said wall and said blade tips and means including a secondary pressurizable chamber responsive to engine operating conditions to apply a secondary pressure on said wall to produce a further adjustment of said clearance in accordance with engine operating conditions, said last mentioned means being located within said first pressurizable chamber and including a wall to define the secondary pressurizable chamber, means on said wall movable upon pressurization of said secondary pressurizable chamber to produce a concentrated load on the deflectable wall to shape it in an axial direction to variably control blade tip clearance between the leading and trailing edges of said blades.

4. A turbine blade tip seal assembly for use in controlling blade tip gas bypass as motive fluid is directed across a turbine blade row comprising: a fixed outer shroud with a deflectable wall, a turbine rotor having blades thereon with tips located in close spaced relationship to said deflectable wall and including leading and trailing edges, means forming a first pressurizable chamber inflatable to a predetermined pressure to deflect said wall radially inwardly into a controlled radial clearance with said tips to prevent excessive gas bypass between said wall and said blade tips, and means including a secondary pressurizable chamber responsive to engine operating conditions to apply to secondary pressure on said wall to produce a further adjustment of said clearance in accordance with engine operating conditions, said last mentioned means being located within said first pressurizable chamber and including a channel member having spaced walls to define a sealed secondary pressurizable chamber, said channel member further including a dependent rib forced against said deflectable wall by pressurization of said secondary pressurizable chamber thereby to produce a concentrated load on the deflectable wall to shape it in an axial direction to variably control blade tip clearance between the leading and trailing edges of said blades.

* * * * *